US006793313B1

(12) United States Patent
Adachi et al.

(10) Patent No.: US 6,793,313 B1
(45) Date of Patent: Sep. 21, 2004

(54) INK EVALUATION METHOD, INK, AND INK JET UNIT

(75) Inventors: Kouchi Adachi, Shimizu (JP); Minoru Koyata, Shizuoka (JP); Atsushi Kubota, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/395,359

(22) Filed: Mar. 24, 2003

(30) Foreign Application Priority Data

Mar. 4, 2003 (JP) ..... 2003-057278

(51) Int. Cl.[7] ..... B41J 29/393; B41J 2/175; B41J 29/38

(52) U.S. Cl. ..... 347/19; 347/85; 347/14

(58) Field of Search ..... 347/19, 85, 14, 347/84, 23, 6, 7, 86

(56) References Cited

U.S. PATENT DOCUMENTS

| | | | | |
|---|---|---|---|---|
| 4,091,390 A | | 5/1978 | Smith et al. | |
| 5,268,767 A | | 12/1993 | Kurtin et al. | |
| 5,447,562 A | | 9/1995 | Maeda et al. | |
| 5,489,925 A | * | 2/1996 | Brooks et al. | 347/6 |
| 5,561,454 A | | 10/1996 | Kurabayashi et al. | |
| 5,889,084 A | | 3/1999 | Roth | |
| 6,145,979 A | | 11/2000 | Caiger et al. | |
| 6,155,664 A | * | 12/2000 | Cook | 347/7 |
| 6,357,867 B1 | | 3/2002 | Hine | |
| 6,447,112 B1 | | 9/2002 | Hu et al. | |
| 6,517,191 B1 | | 2/2003 | Koitabashi | |
| 2002/0064631 A1 | | 5/2002 | Wakabayashi et al. | |
| 2003/0063172 A1 | | 4/2003 | Ohtsu et al. | |

FOREIGN PATENT DOCUMENTS

| | | |
|---|---|---|
| EP | 0 756 941 A2 | 2/1997 |
| EP | 1 066 968 | 1/2001 |
| EP | 1 066 968 A2 A3 | 1/2001 |
| JP | 02-117880 | 5/1990 |
| JP | 03-065345 | 3/1991 |
| JP | 07-090210 A | 4/1995 |
| JP | 09-156203 | 6/1997 |
| JP | 10-316915 | 12/1998 |
| JP | 11-020176 | 1/1999 |

* cited by examiner

*Primary Examiner*—Stephen Meier
*Assistant Examiner*—Charles Stewart, Jr.
(74) *Attorney, Agent, or Firm*—Frishauf, Holtz, Goodman & Chick, P.C.

(57) ABSTRACT

An ink evaluation method of the present invention comprises: a first step of making a given amount of solution pass through a filter and measuring time for the solution to pass through the filter; a second measurement step of making pass through the filter the ink having a solid material dispersed in a solvent and having the same viscosity and the same amount as those of the solution, and measuring the time for the ink to pass through the filter (filter passing time); a calculation step of calculating a ratio of the filter passing times between the solution and the ink; and a determination step of determining whether the ink discharging stability index is high or not based on the measured ratio. Thus, since the ink having a high spraying stability index can be easily determined, ones having the high spraying stability index out of plural types of ink may be selected.

6 Claims, 4 Drawing Sheets

| measurements | Filter-passing time (S) | | ratio (solution/ink) | Occurrence rate of malfunction |
|---|---|---|---|---|
| | solution | ink | | |
| 1 | 139 | 142 | 0.98 | ◎ |
| 2 | 128 | 132 | 0.97 | ◎ |
| 3 | 181 | 196 | 0.92 | ◎ |
| 4 | 103 | 116 | 0.89 | ○ |
| 5 | 160 | 192 | 0.83 | ○ |
| 6 | 146 | 185 | 0.79 | △ |
| 7 | 105 | 135 | 0.78 | △ |
| 8 | 133 | 179 | 0.74 | × |
| 9 | 137 | 189 | 0.72 | × |
| 10 | 123 | 179 | 0.69 | × |

Fig. 5

| measurements | Filter-passing time (S) | | ratio (solution/ink) | Occurrence rate of malfunction |
|---|---|---|---|---|
| | solution | ink | | |
| 1 | 139 | 142 | 0.98 | ◎ |
| 2 | 128 | 132 | 0.97 | ◎ |
| 3 | 181 | 196 | 0.92 | ◎ |
| 4 | 103 | 116 | 0.89 | ○ |
| 5 | 160 | 192 | 0.83 | ○ |
| 6 | 146 | 185 | 0.79 | △ |
| 7 | 105 | 135 | 0.78 | △ |
| 8 | 133 | 179 | 0.74 | × |
| 9 | 137 | 189 | 0.72 | × |
| 10 | 123 | 179 | 0.69 | × |

INK EVALUATION METHOD, INK, AND INK JET UNIT

BACKGROUND OF THE INVENTION

1. Field of the Invention

The present invention relates to an ink evaluation method for evaluating the stability of ink jet, an ink jet unit for discharging ink in the form of ink droplets and ink used in the ink jet unit.

2. Discussion of the Background

Ink jet units include, for example, an ink jet unit mounted on an ink jet printer. The ink jet unit is basically composed of pressure chambers, from which ink is discharged, the nozzles disposed within the pressure chamber for discharging the ink, and a drive means for discharging the ink in the pressure chamber as ink droplets. Note that the ink is supplied to the pressure chamber from an ink tank through an ink feeding passage, in the middle of which the ink is filtered.

A wide variety of techniques for stably discharging the ink from the nozzles have been proposed with respect to this type of ink jet unit. One of them, for example, is such a technique to enable the ink meeting a given requirement for any pressure loss possibly incurring during passing through the filter to be applied to the ink jet unit (Refer to JP-A No. 90210/1995).

Ink types to be supplied to the ink jet unit include aqueous ink, oil ink, solvent ink, and Ultra Violet ink (UV cure ink) (hereafter, simply referred to as UV ink). The aqueous and oil inks are often used when the ink is applied to water-absorbing objects, while the solvent and UV ink are often used when they are applied to non-water-absorbing objects.

Since the solvent ink has a high volatility index, the nozzles may be clogged due to solvent evaporation to dryness at a high frequency. On the contrary, since the UV ink has a very low volatility index, it may scarcely be clogged due to solvent evaporation to dryness. This type of UV ink gets cured by photo-curing reaction with a UV ray. This means that the reaction between a photopolymerization initiator contained in the UV ink and a monomer or oligomer is induced by a UV ray to form a highly polymerized compound, resulting in the cured UV ink. In addition to this property, the UV ink has such another property that it tends to get cured in a short period of time, for example within one second after being discharged, preventing an organic solvent contained it from evaporating. Further, the UV ink is excellent in abrasion resistance than other types of ink. Owing to these advantages, a demand for UV-ink ink jet units is increasingly growing.

On the other hand, in any types of ink such as the UV ink, in which a pigment is dispersed, the pigment tends to easily agglutinate, leading to possible malfunction of discharging. This may cause a problem of deteriorated stability of ink discharging performance. Thus, the ink with a higher stability index of ink discharging performance is desired and it is a criterion for ink evaluation whether the ink discharging stability index is acceptable.

SUMMARY OF THE INVENTION

Accordingly, an object of the present invention is to provide an ink evaluation method, which allows the preferred ink with a high discharging performance to be selected out of various types of ink.

Another object of the present invention is to provide the ink jet unit capable of discharging stably the ink from the nozzles and the ink suitable for the unit.

These objects of the present invention can be achieved by a novel ink evaluation method, ink, and ink jet unit of the present invention.

The new ink evaluation method of the present invention, therefore, comprises: a first measurement step of making a given amount of solution pass through a filter and measuring the time for the solution to pass through the filter (filter passing time); a second measurement step of making pass through the filter the ink having a solid material dispersed in a solvent and having the same viscosity and the same amount as those of the solution, and measuring the time for the ink to pass through the filter (filter passing time); a calculation step of calculating a ratio of the filter passing times between the solution and the ink; and a determination step of determining whether the ink discharging stability index is acceptable based on the measured ratio.

As known from the description above, the novel ink of the present invention is the ink determined to have a higher ink discharging stability index based on the novel ink evaluation method of the present invention.

Thus, the novel ink discharging unit of the present invention is configured so that the ink determined to have a higher ink discharging stability index based on the novel ink evaluation method of the present invention may be contained in it and discharged as ink droplets.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 5 is a view explaining filter passing times and occurrence rates of malfunction of ink discharge.

DETAILED DESCRIPTION OF THE PREFERRED EMBODIMENTS

<Ink Jet Unit>

Figure 1:
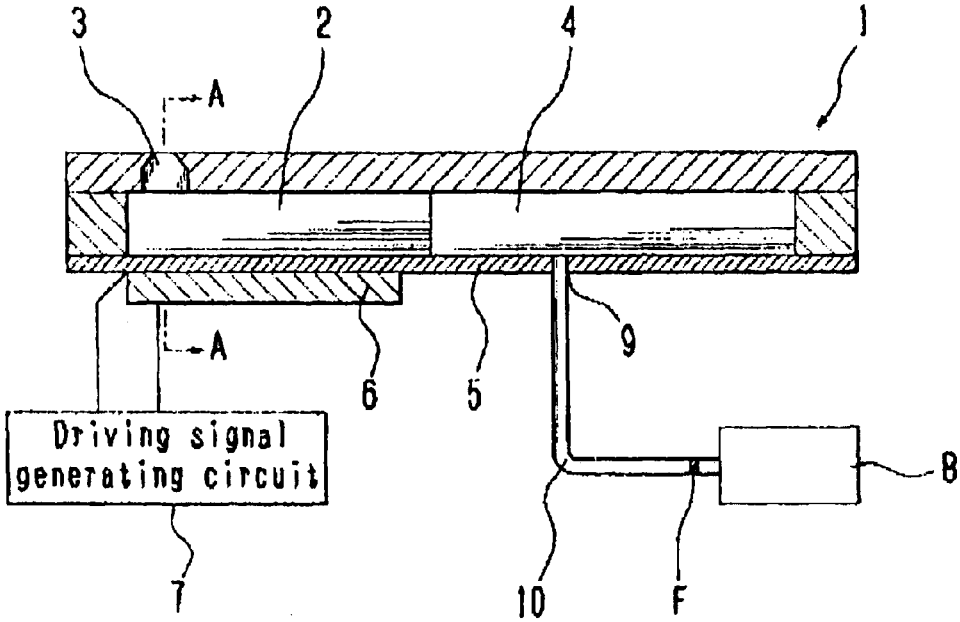
FIG. 1 is a longitudinal side view schematically showing an ink jet unit according to one embodiment of the present invention.
Figure 2:
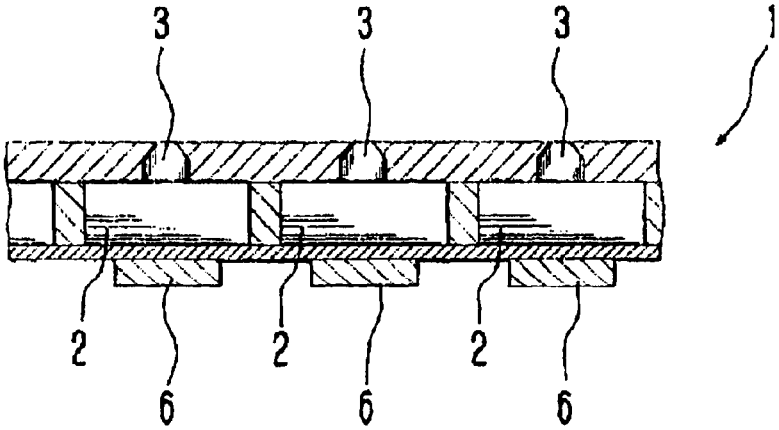
FIG. 2 is a cross sectional view taken from a A—A line of the ink jet unit.

Now, referring to FIGS. 1 and 2, an ink jet unit according to one embodiment of the present invention is described.

FIG. 1 is a longitudinal side view schematically showing the ink jet unit 1 and FIG. 2 is a cross sectional view taken from an A—A line of the side view.

The ink jet unit 1 has plural pressure chambers 2 containing ink. In these pressure chambers 2, nozzles 3 for discharging ink droplets are disposed. The plural pressure chambers 2 are configured so that the ink may be fed to each of them from a common ink chamber. Bottoms of the plural pressure chambers 2 are formed by diaphragms 5. On the undersides of the diaphragms, plural piezoelectric elements 6 corresponding to the individual pressure chambers 2 are fixedly disposed. The diaphragms 5 and the piezoelectric elements 6 form an actuator, and the piezoelectric elements 6 are electrically connected to an output terminal of a driving signal generating circuit 7. In the common ink chamber, an ink supply port 9 for feeding the ink from an ink tank 8 is formed. To the ink supply port 9, the ink tank 8 is connected via an ink feeding passage 10. In the ink feeding passage 10, a filter F for removing impurities from the ink is placed. The ink determined to have a high discharging stability index based on an ink evaluation method mentioned later is contained in the ink tank 8.

This type of ink jet until, when a driving signal is applied to the piezoelectric elements 6 from the driving signal generating circuit 7, distorts the piezoelectric elements 6 to vibrate the diaphragms 5. The vibrations of the diaphragms 5 change the capacities of the pressure chambers 2. In the process of an increase in capacity of the pressure chambers 2, the ink contained in the common ink chamber 4 is absorbed by the pressure chambers 2 and in the process of a decrease in capacity of the pressure chambers 2, the ink contained in the pressure chambers 2 is made into droplets and discharged outward from nozzles 3.

The ink is composed at least of an insoluble color material and a solvent. This means that the ink is the ink containing a solid pigment as the color material, dispersed in the solvent. These types of ink include the ink types such as one, which gets cured when being irradiated by radiant ray. The ink type, which gets cured when being irradiated by the radiant ray, includes, for example, UV ink (UV cured ink). Specifically, this UV ink is composed of a solid material as the color material, a monomer, an oligomer, a photopolymerization initiator, a dispersing agent, and others.

Note that in this embodiment, the piezoelectric elements 6 are used as actuators but not limited to them. Alternately, the ink jet unit of the present invention may be configured so that heating elements are used as the actuators for bringing the ink to the boil to discharging the ink droplets from the nozzles 3.

<Ink Evaluation Method>

The ink evaluation method for evaluating the ink discharging stability index is explained. This evaluation method comprises: a first measurement step of making a given amount of solution to pass through a filter and measuring the time for the solution to pass through the filter (filter passing time); a second measurement step of making the ink having the same viscosity and the same amount as those of the solution to pass through the filter used in the first step and measuring the time for the ink to pass through the filter (filter passing time); a calculation step of calculating a ratio of the filter passing times between the solution and the ink; and a determination step of determining whether the ink discharging stability index is acceptable based on the calculated ratio.

Note that the first and second measurement steps can be continuously performed without replacing a filter F with a new one. In the determination step, the ink, which meets such a criterion that the ratio calculated in the calculation step shall be within a range of 0.8–1.0, is determined to have a high discharging stability index. In this case, The filter F used in the first and second steps has filtration pores of the same size (hereafter, the size of the filtration pores is simply referred to as a pore size).

Thus, since it can be easily determined whether the inks have a high discharging stability index by measuring the filter passing times of the solution and the ink, calculating the ratio between them, and using the calculated ratio as the criterion for determination, the ink type having a high discharging stability index may be selected among plural types of ink.

As a result, the ink selected in this manner can be used in the ink jet unit 1 to enable the ink jet unit 1 to stably discharge the ink from the nozzles 3. In this case, the ink having a high discharging stability index is contained in the ink tank 8. The ink is fed to the filter F from the ink tank 8 through the ink feeding passage 10 and then to the common ink chamber 4 and the pressure chambers 2.

<Filter Passing Time Measurement Method>

Figure 3:
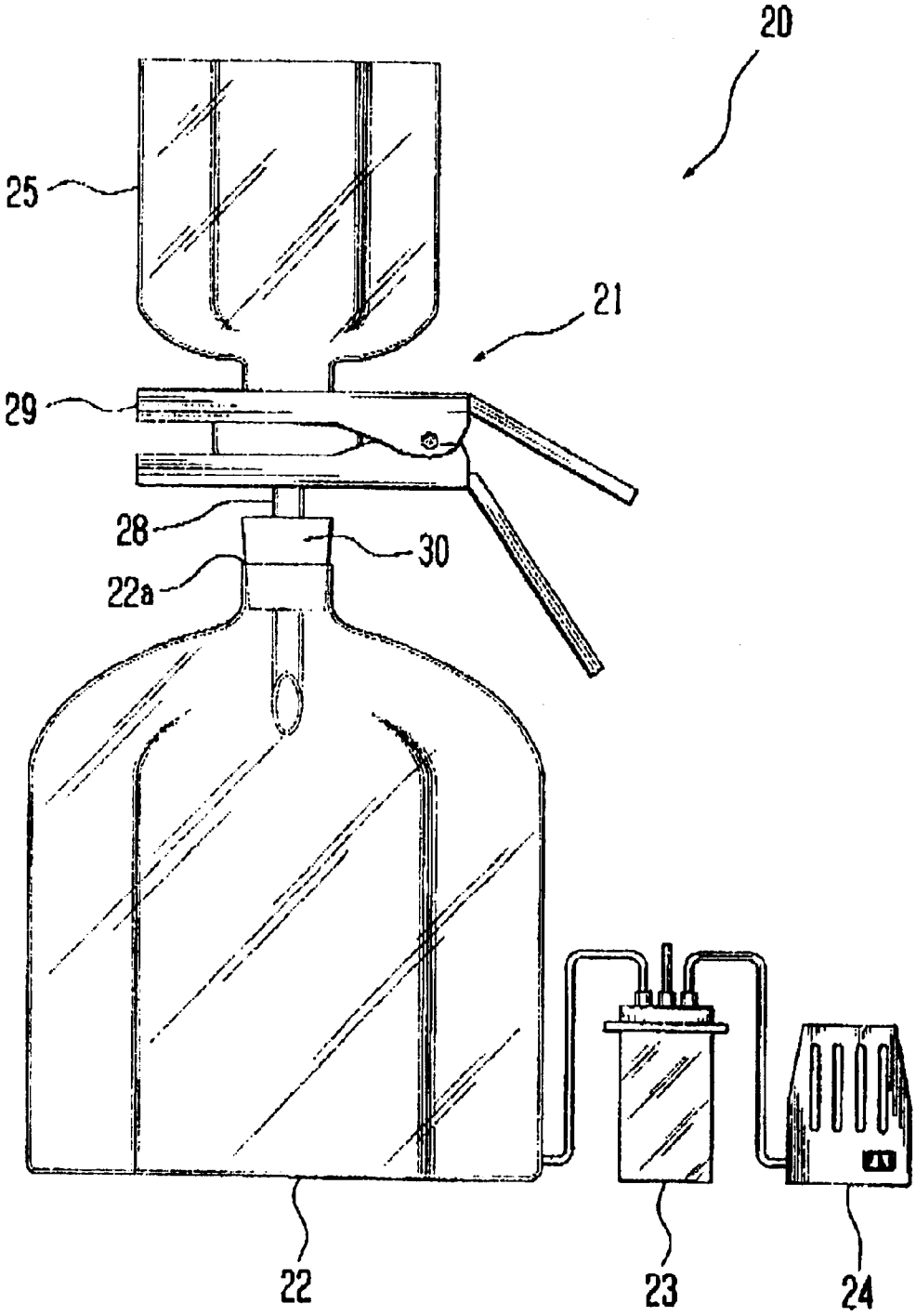
FIG. 3 is a side view schematically showing reduced-pressure filtration equipment.
Figure 4:
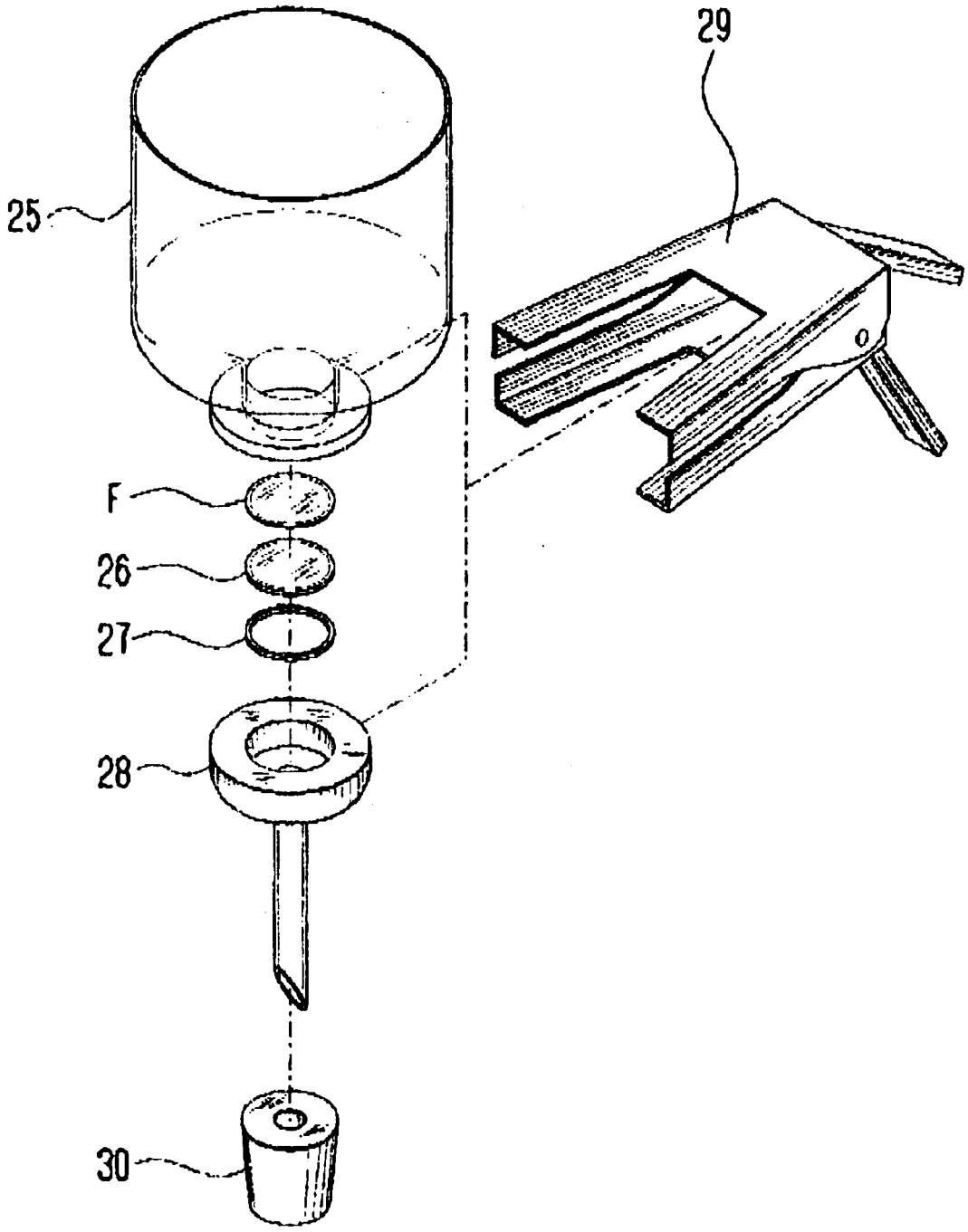
FIG. 4 is a perspective view schematically showing the appearance or a filter holder.

Now, referring to FIGS. 3 and 4, the filter passing times measurement method used in the first and second measurement steps is explained. FIG. 3 is a schematic side view of reduced-pressure filtration equipment and FIG. 4 is a schematic perspective view of the appearance of the filter holder.

The filter passing time measurement method is intended to measure the filter passing times required for sample liquids such as the solution and the ink to pass through the filter F using, for example, reduced-pressure filtration equipment 20.

The reduced-pressure filtration equipment 20 has a filter holder 21, a pressure reduction vessel 22, a trap 23, a suction pump 24 and the like. The filter holder 21 is comprised of a funnel 25 for containing the sample liquid, a support screen 26 for supporting the filter F, a PTFE gasket 27, a base 28 for introducing the sample liquid made to pass through the filter F into the pressure reduction vessel 22, clamps 29 for hermetically fixing the funnel 25 to the base 28 via the support screen 26 and the PTFE gasket 27, and the like. The filter holder 21 is disposed at an opening 22*a* of the pressure reduction vessel 22 via a rubber stopper 30. The pressure reduction vessel 22 is connected to the suction pump 24 through a tube via the trap 23. The suction pump 24 has a pressure gauge (not shown in the figure). In this case, when the suction pump 24 is driven, air is sucked from the pressure reduction vessel 22, resulting in depressurization in it. This allows the sample liquid introduced into the funnel 25 to pass through the filter F.

The procedure for measuring the times for the sample liquid such as the solution and the ink to pass through the filter is explained below. In this description, it is assumed that the time for the solution to pass through the filter is measured and then the time for the ink to pass through the filter is measured.

A measurer attaches the rubber stopper 30 and the base 28 to the pressure reduction vessel 22, places the PTFE gasket 27, the support screen 26, the filter F, and the funnel 25 on the base 28 sequentially, and fixes them to the pressure reduction vessel 22 with clamps 29. Then, the measurer puts a trace amount of solution in the funnel 25 using, for example, a pipette to wet the filter F uniformly and drives the suction pump 24 to adjusts the pressure in the pressure reduction vessel 22 to be a given pressure using a valve of the trap 23 while watching the pressure gauge. This achieves the reduction of the pressure in the pressure reduction vessel 22 to the given value.

First, the time for the solution to pass through the filter is measured. The measurer starts measuring the filter passing time using, for example, a stopwatch at the moment he/she puts the solution in the funnel 25 of the filter holder 21. The solution put in the funnel 25 passes through the filter F. This means that the solution is filtered by the filter F. The measurer stops measuring the filter passing time using, for example, a the stopwatch at the moment an entire amount of the solution put in the funnel 25 flows out. This achieves the filter-passing time measurement for the solution.

Subsequently, the measurer measures the filter-passing time for the ink without replacing the filter F with a new one. The measurer starts measuring the filter passing time using, for example, a stopwatch at the moment he/she puts the ink in the funnel 25 of the filter holder 21. The ink put in the funnel 25 passes through the filter F. This means that the ink is filtered by the filter F. The measurer stops measuring the filter passing time using, for example, the stopwatch at the moment an entire amount of the ink put in the funnel 25 flows out. This achieves the filter-passing time measurement for the ink.

In this way, the solution or the ink is put in the funnel 25 and the filter-passing times are measured. Note that the same volume of solution and ink with the same viscosity should be put in the funnel 25.

<Discharging Stability Determination Method>

The discharging stability determination method used in the determination step is explained below. In this method, for example, by evaluating the occurrence rate of malfunction of discharging when the ink is continuously discharged for one hour from the nozzles 3 using the ink jet unit 1, it is determined whether the ink has a high discharging stability index.

In the method for evaluating the occurrence rates of malfunction of discharging, images developed on papers are checked for any defects using the ink jet unit 1. For example, the ink is continuously discharged for one hour from the nozzles 3 into the paper being fed and if any defects are detected on the images, discharging is determined to be malfunctioned. This enables the occurrence rate of malfunction of discharging to be found for each of nozzles 3. Thus, the occurrence rate per hour of malfunction of discharging can be found for each of nozzles 3 and based on the calculated rate, it is determined whether the ink has a high discharging stability index.

<Ink Discharging Stability Evaluation Method>

The stability of ink discharging is evaluated by the ink evaluation method mentioned above. Note that the methods mentioned above are used for the filter-passing time measurement method and the ink discharging stability evaluation method.

For the filter F, a polypropylene filter with a pore size of 5 $\mu$m and a outer diameter of 47 mm$\phi$ is used. The pressure of the pressure reduction vessel 22 is reduced to 100 mmHg. The temperature of the measuring environment is set to 25±1° C.

For the ink, 10 types of UV black pigment ink (measurement samples 1–10) are used. The black pigment ink is composed of 1–10 wt % of color material, 80–95 wt % of UV-cured resin, 3–5 wt % of photopolymerization initiator, and 0.5–5 wt % of dispersing agent. Ten types of ink are composed by adjusting the color material concentration within ±50% and the dispersing agent within ±50%, respectively.

For the color material, carbon black is used. For the UV-cured resin, radical-polymerized monomers and oligomers comprised mainly of acrylates, including mono-, di-, and tri-functional acrylates are used. For the acrylates, for example, acryloyl morpholine, isobornyl acrylate, N-vinyl caprolactam, N-vinyl formamide, tetrahydrofurfuryl acrylate, phenol EO-added acrylate, 1,6-hexane diol acrylate, bisphenol AEO diacrylate, diethylene glycol diacrylate, tetraethylene glycol diacrylate, polyethylene glycol diacrylate, 1,3-butadiol diacrylate, polyethylene glycol diacrelate, glycerine propoxy triacrylate, trimethylolpropane triacrylate, pentaerythritol tri/tetra-acrylate, dipentaerythritol penta/hexa-acrylate, dimethylolpropane tetra-acrylate, aromatic urethane acrylate, or aliphatic urethane acrylate are preferably used.

For all the sample liquids 1–10, a mixture of mineral oil and oleyl alcohol is used. The viscosity of the liquid mixture can be adjusted by varying the mixture ratio between them. Note that for all the sample liquids 1–10, 50 ml of ink and 50 ml of solution are prepared. The solution and the ink have the same viscosity, which has been adjusted to 21.5 mPa·s in this case.

Under these conditions, for every measurement, the filter-passing time of the solution and the filter-passing time of the ink are individually measured by the filter-passing time measurement method. First, the time for the solution to pass through the filter F (filter-passing time) is measured and then the time the ink to pass through the filter F (filter-passing time). At this time, the same filter is used both for the solution and the ink. Note that the filter is replaced with a new one for each of measurements. Subsequently, the ratio of filter-passing time between the solution and the ink is calculated. FIG. 5 shows the results of these measurements and calculations.

Next, for each of measurements, the occurrence rate of malfunction of discharging is found by the discharging stability determination method mentioned above. In this case, the occurrence rate of malfunction of discharging is the probability of occurrence of malfunction in three nozzles per hour. FIG. 5 shows the results of these calculations. In FIG. 5, ⓞ indicates that the occurrence rate of malfunction is equal to or less than 1%, ○ indicates that the occurrence rate of malfunction is larger than 1% and equal to or less than 5%, Δ indicates that the occurrence rate of malfunction is larger than 5% and equal to or less than 20%, and X indicates that the occurrence rate of malfunction is larger than 20%, respectively.

As known from FIG. 5, when the ink meeting the criterion (the ratio shall be within a range of 0.8–1.0%) is used in the ink jet unit 1, the occurrence rate of malfunction of discharging is reduced to a range from 0% or more to 5% or less (Refer to ⓞ and ○ in the figure). In this way, the ink meeting the criterion (the ratio shall be within a range of 0.8–1.0%) is determined to have a high discharging stability index. Thus, since when the ink meeting the criterion (the ratio shall be within a range of 0.8–1.0%) is used in the ink jet unit 1, the occurrence rate of malfunction is within a range from 0% or more to 5% or less, the ink jet unit 1 can discharge stably the ink from the nozzles 3. Note that in this case, the ratio is set to a range from 0.8 or more to 1.0 or less but not limited to it. For example, the ratio may be set to a range from more than 0.8 to 1.0 or less.

Obviously, numerous modifications and variations of the present invention are possible in light of the above teachings. It is therefore to be understood that within the scope of the appended claims, the invention may be practiced otherwise than as specifically described herein.

The present application is based on Japanese Priority Document P2003-057278 filed on Mar. 4, 2003, the content of which is incorporated herein by reference.

What is claimed is:

1. An ink evaluation method comprising:

a first step of making a given amount of solution pass through a filter and measuring time for the solution to pass through the filter;

a second measurement step of making pass through the filter the ink having a solid material dispersed in a solvent and having the same viscosity and the same amount as those of the solution, and measuring the time for the ink to pass through the filter (filter passing time);

a calculation step of calculating a ratio between the filter passing time of the solution and the filter passing time of the ink; and a determination step of determining whether the ink discharging stability index is high or not based on the measured ratio.

2. An ink evaluation method according to claim 1, wherein in the determination step, the inks, for which ratio is within a range from 0.8 to 1.0, is determined to have a high discharging stability index.

3. Ink determined to have a high discharging stability index based on the ink evaluation method defined in claim 2.

4. An ink jet unit configured so that it may contain the ink determined to have a high discharging stability index based on the ink evaluation method according to claim 2 and discharge the ink as ink droplets.

5. Ink determined to have a high discharging stability index based on the ink evaluation method according to claim 1.

6. An ink jet unit configured so that it may contain the ink determined to have a high discharging stability index based on the ink evaluation method according to claim 1 and discharge the ink as ink droplets.

* * * * *